US006651460B2

(12) United States Patent
O'Connor

(10) Patent No.: US 6,651,460 B2
(45) Date of Patent: Nov. 25, 2003

(54) PROCESS AND APPARATUS FOR THE CRYOGENIC SEPARATION OF AIR

(75) Inventor: Declan P. O'Connor, Chessington (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/282,406

(22) Filed: Oct. 29, 2002

(65) Prior Publication Data

US 2003/0101745 A1 Jun. 5, 2003

(30) Foreign Application Priority Data

Dec. 4, 2001 (EP) ..... 01310153

(51) Int. Cl.[7] ..... F25J 3/02
(52) U.S. Cl. ..... 62/646; 62/900
(58) Field of Search ..... 62/646, 643, 900

(56) References Cited

U.S. PATENT DOCUMENTS 4,254,629 A * 3/1981 Olszewski ..... 62/651
5,100,448 A 3/1992 Lockett et al. ..... 62/24
5,331,818 A * 7/1994 Rathbone ..... 62/646
6,128,921 A 10/2000 Guillard et al. ..... 62/643
6,167,723 B1 * 1/2001 Guillard ..... 62/646
6,227,005 B1 * 5/2001 Higginbotham et al. ..... 62/646
6,276,170 B1 * 8/2001 Ha ..... 62/646
6,347,534 B1 * 2/2002 Ha ..... 62/646
6,536,232 B2 * 3/2003 Davidian et al. ..... 62/643

FOREIGN PATENT DOCUMENTS

GB 2057660 4/1981 ..... B01D/3/16
WO 84/04957 12/1984

OTHER PUBLICATIONS

"Intermediate Pressure Column in Air Separation", *Research Disclosure* 42544, (Sep. 1999/1185) (anonymous).

* cited by examiner

*Primary Examiner*—William C. Doerrler
(74) *Attorney, Agent, or Firm*—Willard Jones, II

(57) ABSTRACT

Oxygen-containing gas comprising no more than about 50 mol % oxygen is fed (150) to an auxiliary separation column (40) in a multiple column cryogenic air distillation system comprising at least a higher pressure ("HP") column (10) and a lower pressure ("LP") column (30) for separation into nitrogen-rich overhead vapor and oxygen-rich liquid. Oxygen-rich liquid is fed (154) from the auxiliary column (40) to an intermediate location in the LP column (30). The auxiliary column (40) is refluxed with a liquid stream from or derived from the HP column (10). One advantage of the invention is that the diameter of the upper sections (II, III) of the LP column (30) need no longer be larger than the diameter of the rest of the column system thereby increasing the capacity of the column system (under the constraint of a defined maximum column section diameter).

31 Claims, 3 Drawing Sheets

PROCESS AND APPARATUS FOR THE CRYOGENIC SEPARATION OF AIR

TECHNICAL FIELD OF THE INVENTION

The present invention relates to the field of cryogenic air distillation using an air separation unit ("ASU") comprising more than one cryogenic distillation column. The present invention has particular application to an ASU having a thermally integrated double column distillation system comprising a higher pressure ("HP") column and a lower pressure ("LP") column.

BACKGROUND OF THE INVENTION

The distillation columns of an ASU have a plurality of column sections. The hydraulic loading of the various column sections can vary significantly and it is common to use two or more different diameters for the column sections, especially when structured packing is used as the mass transfer elements in the columns.

The upper sections of the LP column of a double column system usually determine the largest diameter used in the column system, as it is at this location that typically the column system has the largest volumetric flow of vapor. For a defined maximum column diameter in the double column system, the upper sections of the LP column are usually the bottleneck for the capacity rating of the column system. The HP column and lower sections of the LP column would allow a higher plant capacity if their diameters were increased towards the stated maximum diameter value. If the double column capacity could be increased without increasing the maximum double column section diameter then the footprint of the column system and associated piping would be largely unchanged.

An advantage of reducing the flow bottleneck in the upper sections of the LP column would be that the capacity of the double column system could be increased (under the constraint of a particular defined maximum column diameter). In addition, the ability for very large columns to be shipped is often determined by the maximum column section diameter. If the above flow bottleneck could be reduced then the maximum capacity of a single train double column could be increased.

U.S. Pat. No. 5,100,448 (published on Mar. 31, 1992) discloses a column system using structured packing, where a lower density (higher capacity) structured packing is used in column sections having a high hydraulic load and higher density (lower capacity) packing is used in sections having a low hydraulic load. While this could achieve the objective mentioned above, low density packing has substantially poorer mass transfer performance than higher density packing.

U.S. Pat. No. 6,128,921 (published on Oct. 10, 2000) discloses an arrangement of multiple LP columns to increase the capacity of the plant, with each LP column providing part of the product. It does not address the problem that it is only the upper sections of the LP column that cause the initial capacity bottleneck for the double column system.

U.S. Pat. No. 6,227,005 (published on May 8, 2001), WO-A-84/04957 (published on Dec. 20, 1984) and an article in Research Disclosure by Richard Mason Publications entitled "Intermediate Pressure Column in Air Separation" (No. 425, September 1999, pp 1185 to 1186, XP-000889172) all disclose processes for the production of oxygen and nitrogen using a distillation column system having at least three distillation columns, each column operating at a different pressure and each intermediate pressure column having at least one reboiler/condenser.

The purpose of the intermediate pressure column in both U.S. Pat. No. 6,227,005 and WO-A-84/04957 is to pre-separate a liquid oxygen containing feed stream into further enriched bottoms liquid and oxygen lean overhead gas.

It is an object of the invention to provide an ASU comprising a multiple column distillation system having an increased capacity within the constraint of a defined maximum column section diameter. The inventor has found that this can be achieved by routing a small fraction of the vapor flow which would normally pass through the upper LP column sections through an auxiliary separation column which is refluxed by a liquid stream from or derived from the HP column. Usually, the vapor flow rate in the auxiliary column is less than about 25%, preferably less than about 20% and most preferably less than about 15%, of the vapor flow rate in the upper LP column sections. Bottoms liquid from the auxiliary column is returned to the LP column at an intermediate location above the bottom section.

SUMMARY OF THE INVENTION

Air is separated cryogenically using a multiple column distillation system comprising at least an HP column and an LP column. The process comprises feeding cooled feed air to the HP column for separation into HP nitrogen-enriched overhead vapor and crude liquid oxygen ("CLOX") and feeding at least one LP column feed stream comprising nitrogen and oxygen to the LP column for separation into LP nitrogen-rich overhead vapor and liquid oxygen ("LOX"), the LP column being refluxed with a liquid stream from or derived from the HP column. Oxygen-containing gas comprising no more than about 50 mol % oxygen is fed to an auxiliary separation column for separation into auxiliary column nitrogen-rich overhead vapor and oxygen-rich liquid. Oxygen-rich liquid from the auxiliary column is fed to an intermediate location in the LP column and the auxiliary column is refluxed with a liquid stream from or derived from the HP column.

In preferred embodiments, the purpose of the auxiliary column is to unload the upper sections of the LP column by feeding it with a gas stream that would otherwise have had to pass through the LP column upper sections.

The apparatus comprises an HP column for separating cooled feed air into HP nitrogen-enriched overhead vapor and CLOX, an LP column for separating at least one LP column feed stream comprising nitrogen and oxygen into LP nitrogen-rich overhead vapor and LOX, conduit means for feeding a liquid stream from or derived from the HP column as reflux to the LP column; an auxiliary separation column for separating oxygen-containing gas comprising no more than about 50 mol % oxygen into auxiliary column nitrogen-rich overhead vapor and oxygen-rich liquid, conduit means for feeding oxygen-rich liquid from the auxiliary column to an intermediate location in the LP column and conduit means for feeding a liquid stream from or derived from the HP column as reflux to the auxiliary column.

DETAILED DESCRIPTION OF THE INVENTION

Figure 2:
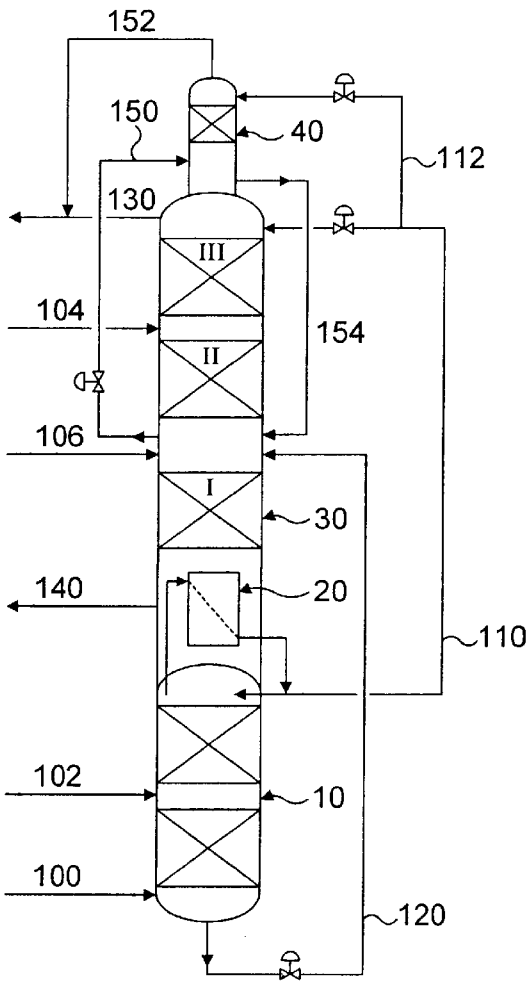
FIG. 2 is a diagrammatic representation of an embodiment of the present invention based on the typical system in FIG. 1 in which oxygen-containing gas for the auxiliary column is taken from an intermediate location in the LP column.

According to a first aspect of the present invention, there is provided a process for the cryogenic separation of air using a multiple column distillation system comprising at least a higher pressure ("HP") column and a lower pressure ("LP") column, said process comprising:

feeding cooled feed air to the HP column for separation into HP nitrogen-enriched overhead vapor and crude liquid oxygen ("CLOX");

feeding at least one LP column feed stream comprising nitrogen and oxygen to the LP column for separation into LP nitrogen-rich overhead vapor and liquid oxygen ("LOX");

refluxing the LP column with a liquid stream from or derived from the HP column;

feeding oxygen-containing gas comprising no more than about 50 mol % oxygen to an auxiliary separation column for separation into auxiliary column nitrogen-rich overhead vapor and oxygen-rich liquid;

feeding oxygen-rich liquid from the auxiliary column to an intermediate location in the LP column; and refluxing the auxiliary column with a liquid stream from or derived from the HP column.

In preferred embodiments, the oxygen-containing gas is, effectively, "washed" with nitrogen-enriched liquid to prevent loss of oxygen molecules in the overhead vapor.

Preferably, the vapor flow rate in the auxiliary separation column is determined such that the diameters of the upper sections of the LP column are not larger than that for any other section of the multiple distillation column system. Usually, the vapor flow rate in the auxiliary column is less than about 25%, preferably less than about 20% and most preferably less than about 15%, of the vapor flow in the upper LP column sections.

The oxygen-containing gas may comprise from about 50 to about 10 mol % oxygen.

In one preferred embodiment, the oxygen-containing gas comprises gas removed from an intermediate location in the LP column. Preferably, the gas is removed from a location below the upper sections of the LP column having the highest volumetric flow of vapor in the LP column.

In another preferred embodiment, the oxygen-containing gas comprises flash vapor produced from reducing the pressure of at least a portion of the CLOX produced in the HP column. The quantity of CLOX flash vapor formed if the CLOX is not subcooled can be as high as 15 mol % of the CLOX flow. The flash vapor could be separated from any CLOX remaining after pressure reduction outside the column system before being fed to the auxiliary separation column. However, it is convenient to feed the CLOX stream to the auxiliary separation column, ideally to the bottom of the column, where it would be separated in the sump of the column.

In yet another preferred embodiment, the oxygen-containing gas comprises a proportion of the feed air to the distillation system. In such embodiments, the oxygen-containing gas preferably comprises at least a portion of a discharge stream from an air expansion turbine. Part of the turbine discharge stream may be fed to the LP column.

Oxygen-containing gas from two or more of these sources may be fed to the auxiliary column at any one time. For example, the auxiliary column may be fed with CLOX flash vapor supplemented by oxygen-containing gas removed from an intermediate location in the LP column and/or discharged from an air expansion turbine.

Usually, the operating pressure of the auxiliary separation column is the same as the operating pressure of the LP column. Such a pressure relationship allows gaseous nitrogen ("GAN"), removed from the top of the LP column, to be combined with auxiliary column nitrogen-rich overhead vapor, removed from the auxiliary column, without pressure adjustment, to form a combined nitrogen product stream. However, the operating pressure of the auxiliary separation column may different from the operating pressure of the LP column. Pressure adjustment would, therefore, be required for any streams travelling between the LP column and the auxiliary pressure separation column.

Preferably, the process further comprises removing HP nitrogen-enriched overhead vapor from the top of the HP column, condensing at least a portion thereof in a reboiler/condenser located in the bottom of the LP column and feeding at least a portion of the condensed nitrogen as reflux to the HP column. The LP column and the auxiliary column may be refluxed with condensed nitrogen produced in the reboiler/condenser or with fluid removed from an intermediate location in the HP column. The source of the reflux for the LP column is not necessarily the same as that for the auxiliary column. The auxiliary column is usually refluxed with condensed nitrogen produced in the reboiler/condenser.

Optionally, liquid air may also be fed to the HP column for certain process cycles. In addition, a portion of the HP nitrogen-enriched overhead vapor may be removed as HPGAN product. Further, a portion of the nitrogen condensed in the reboiler/condenser could be removed as a liquid nitrogen ("LIN") product.

CLOX may be subjected to heat transfer or distillation before being fed to the LP column. Some processes may require a liquid air feed and/or an air expander exhaust feed to the LP column.

Liquid feed streams to the columns may be subcooled.

According to a second aspect of the present invention, there is provided apparatus for the cryogenic separation of air by the process according to the first aspect, said apparatus comprising:

an HP column for separating cooled feed air into HP nitrogen-enriched overhead vapor and CLOX;

an LP column for separating at least one LP column feed stream comprising nitrogen and oxygen into LP nitrogen-rich overhead vapor and LOX;

conduit means for feeding a liquid stream from or derived from the HP column as reflux to the LP column, said apparatus being characterised in that it further comprises:

an auxiliary separation column for separating oxygen-containing gas comprising no more than about 50 mol % oxygen into auxiliary column nitrogen-rich overhead vapor and oxygen-rich liquid;

conduit means for feeding oxygen-rich liquid from the auxiliary column to an intermediate location in the LP column; and conduit means for feeding a liquid stream from or derived from the HP column as reflux to the auxiliary column.

The LP column has a number of distillation sections. Preferably, the diameters of the upper sections of the LP column are not larger than that for any other section of the multiple distillation column system. Usually, the size of the auxiliary separation column is such that the auxiliary column can accommodate a vapor flow rate of less than about 25%, preferably less than about 20% and most preferably less than about 15%, of the vapor flow rate in the upper LP column sections.

In one preferred embodiment of the second aspect of the present invention, the apparatus further comprises conduit means for feeding oxygen-containing gas from an intermediate location in the LP column to the auxiliary separation column. The intermediate location should be below the upper sections of the LP column having the highest volumetric flow of vapor in the LP column.

In another preferred embodiment, the apparatus further comprises pressure reduction means for producing flash vapor from CLOX removed from the HP column and conduit means for feeding said flash vapor to the auxiliary separation column.

In yet another preferred embodiment, the apparatus further comprises conduit means for feeding to the auxiliary column a proportion of the feed air to the distillation system. In such embodiments, the apparatus preferably further comprises an air expansion turbine and conduit means for feeding at least a portion of a discharge stream from said turbine to the auxiliary separation column.

As oxygen-containing gas from two or more of these sources may be fed to the auxiliary column at any one time, the apparatus may comprise any combination of the features of these preferred embodiments.

Generally, the apparatus will further comprise:

a reboiler/condenser for condensing at least a portion of said HP nitrogen-enriched overhead vapor by indirect heat exchange against LOX in the bottom of the LP column;

conduit means for feeding HP nitrogen-enriched vapor from the top of the HP column to the reboiler/condenser; and conduit means for feeding at least a portion of condensed nitrogen as reflux from the reboiler/condenser to the top of the HP column. The apparatus may comprise conduit means for feeding condensed nitrogen as reflux to the LP column, the auxiliary separation column or to both of said columns. The apparatus may comprise conduit means for feeding a fluid removed from an intermediate location in the HP column as reflux to the LP column, the auxiliary separation column or to both of said columns. The apparatus usually comprises conduit means for feeding condensed nitrogen as reflux to the auxiliary separation column.

The auxiliary column may be located anywhere in space relative to the multiple column distillation system. For convenience, the auxiliary column is preferably elevated such that oxygen-rich liquid in the bottom of the column can be fed to the LP column under gravity although it could be located alongside the LP column or even below the LP column and oxygen-rich bottoms liquid may be pumped to the LP column. In most multiple column cryogenic distillation systems, the auxiliary column will be located directly above the LP column.

In systems involving the use of a "tophat" section at the top of the LP column, the tophat section and the auxiliary column could be integrated to form a divided column. In such embodiments, any geometry may be used to divide the cross-section of the two columns. For example, in embodiments where the auxiliary column is located alongside the tophat section, the auxiliary column could surround the tophat section or vice versa in an annular configuration. Alternatively, the columns may be sectors or segments of a common outer circular shell or even a square column inside a column. Any suitable configuration of divided column may be used.

The auxiliary column vapor flow rate is usually less than 25% of the vapor flow rate in the upper sections of the LP column. The addition of the auxiliary column specifically addresses the situation that it is only the upper sections of the LP column that determine the maximum double column section diameter. By use of the invention, either the maximum column diameter may be reduced or the double column system capacity increased. In addition, standard higher density packing having excellent mass transfer characteristics can be used in all sections of the columns (in contrast to the teaching of U.S. Pat. No. 5,100,448).

The auxiliary column is relatively inexpensive as it has a diameter that is usually less than that for the LP column and does not require many theoretical stages for mass transfer. In addition, it does not require any additional reboilers or condensers if prior art cycles are to be adapted by way of the invention.

Rather than use multiple LP columns to increase the plant capacity (such as in U.S. Pat. No. 6,128,921), the capacity of a typical double column distillation system can be significantly increased by the addition of an auxiliary column having a vapor flow rate of usually less than 25% of that in the upper sections of the LP column. Further, the auxiliary column typically has less than fifteen and preferably about ten theoretical stages of separation which allows it to be located such that the capacity increase of the multiple column is achieved while having minimal impact on the size of the cold enclosure.

Figure 1:
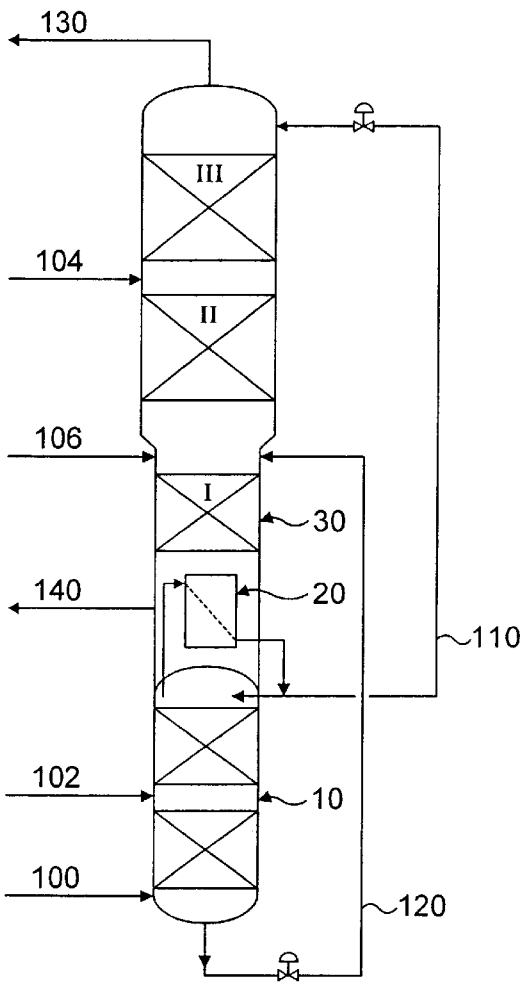
PRIOR ART FIG. 1
FIG. 1 is diagrammatic representation of a typical double column cryogenic air distillation system.

Referring to FIG. 1, cooled compressed air 100 is fed to the HP column 10. Optionally, a liquid air stream 102 may also be fed to the HP column 10 for some process cycles. In the HP column 10, separation is effected to give an overhead nitrogen-enriched stream, part of which could optionally be withdrawn as product HPGAN and the balance condensed in reboiler 20. Part of the condensed nitrogen is returned to the HP column 10 as reflux and the balance is withdrawn as stream 110 to provide reflux for the LP column 30 (and, optionally, a LIN product).

A CLOX stream 120 is withdrawn from the HP column 10 and passed to an intermediate point of the LP column 30 (optionally after being subjected to heat transfer or distillation in unshown columns or exchangers). For some double column cycles, the LP column 30 may also have a liquid air feed stream 104 and/or an expander discharge/exhaust feed stream 106. Optionally, the liquid streams feeding the columns may be subcooled but such subcooling is not shown in the figures.

In the LP column 30, separation is effected to give an overhead waste nitrogen stream 130 and a bottoms oxygen product stream 140. The LP column is shown as having three sections I, II, III although there would be a further section in the system of FIG. 1 if the expander stream 106 entered the column at a different point than the CLOX stream 120. Also there could be additional sections in the lower zone of the LP column if the process cycle included additional columns or exchangers, which were used to pretreat the CLOX feed and/or produce argon.

It should be noted that, in FIG. 1, the upper two sections II, III would typically have the highest volumetric flow of vapor in the LP column 30. In general, column hydraulic loadings would require those sections to have a significantly larger diameter than sections in the lower zone of the LP column 30, especially if structured packing were employed as the mass transfer elements.

In the remaining figures, the same reference numerals are used to refer to parts of the apparatus that correspond with those shown in FIG. 1.

In FIG. 2, a vapor stream 150 having an oxygen concentration of less than about 50 mol % $O_2$ but more than about 10 mol % $O_2$ is withdrawn from the LP column 30 from below the most highly loaded sections II, III and routed to the bottom of auxiliary separation column 40 where it is separated into oxygen-rich liquid and auxiliary column nitrogen-rich overhead vapor. The flowrate of stream 150 is typically determined such that the upper sections II, III of the LP column 30 no longer have to have a diameter larger than any other double column section diameter.

The auxiliary column 40 is provided with at least a reflux stream 112 originating from the HP column 10. Oxygen-rich liquid from the auxiliary column 40 is passed as stream 154 back to an intermediate point in the LP column 30. The overhead vapor stream 152 from the auxiliary column 40 is combined with the waste nitrogen gas stream 130 from the LP column 30.

In FIG. 2, the auxiliary column 40 is shown located above the LP column, but the auxiliary column 40 could be located elsewhere. Preferably, the auxiliary column 40 is elevated such that the oxygen-rich liquid can pass to the LP column 40 under gravity.

Figure 3:
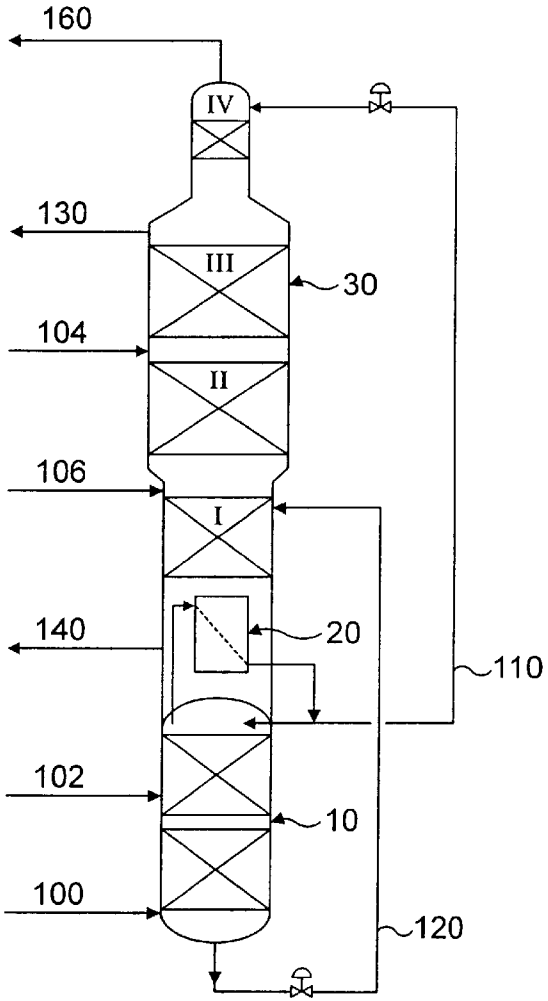
PRIOR ART FIG. 3
FIG. 3 is a diagrammatic representation of a typical double column cryogenic air distillation system in which the LP column has a "tophat" section.

FIG. 3 depicts a double column system of the prior art. The system of this figure is different from that of FIG. 1 in that there is an additional "tophat" section IV in the LP column 30 for the production of LPGAN product which is removed as stream 160. The tophat section IV of the LP column 30 is typical in that it has a smaller diameter than section III because part of the overhead vapor from section III is withdrawn as waste nitrogen in stream 130. As in FIG. 1, LP column upper sections II, III are the most highly loaded sections and, thus, are typical in that they have larger diameters than the rest of the double column sections.

Figure 4:
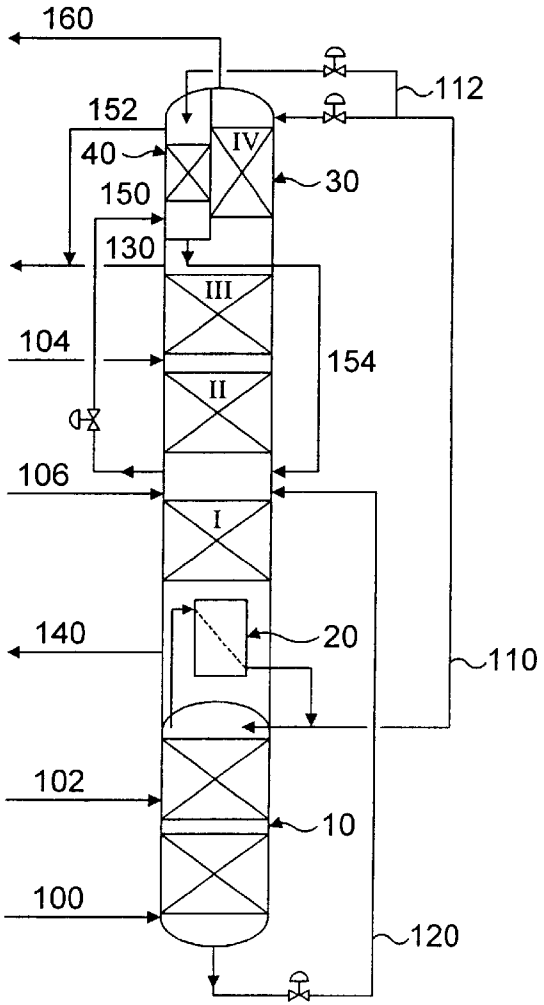
FIG. 4 is a diagrammatic representation of one example of how the embodiment of the invention shown in FIG. 2 may be modified for column systems of the type shown in FIG. 3.

FIG. 4 depicts one possible arrangement in which the system depicted in FIG. 3 has been adapted to include the auxiliary column 40. As in FIG. 2, the auxiliary column 40 processes a fraction of the vapor rising inside the LP column 30 to unload sections II, III. The auxiliary column 40 is shown alongside the LP column tophat section IV as divided columns but it is to be understood that the auxiliary column 40 could surround the tophat section IV or vice versa in an annular configuration. In addition, the auxiliary column 40 could, instead, be located above or alongside the LP column 30.

In FIGS. 2 and 4, the vapor processed by the auxiliary column 40 originates from an intermediate location of the LP column 30. However, any source of low pressure vapor which would otherwise pass up through the LP column to the waste nitrogen take-off point can be used.

Figure 5:
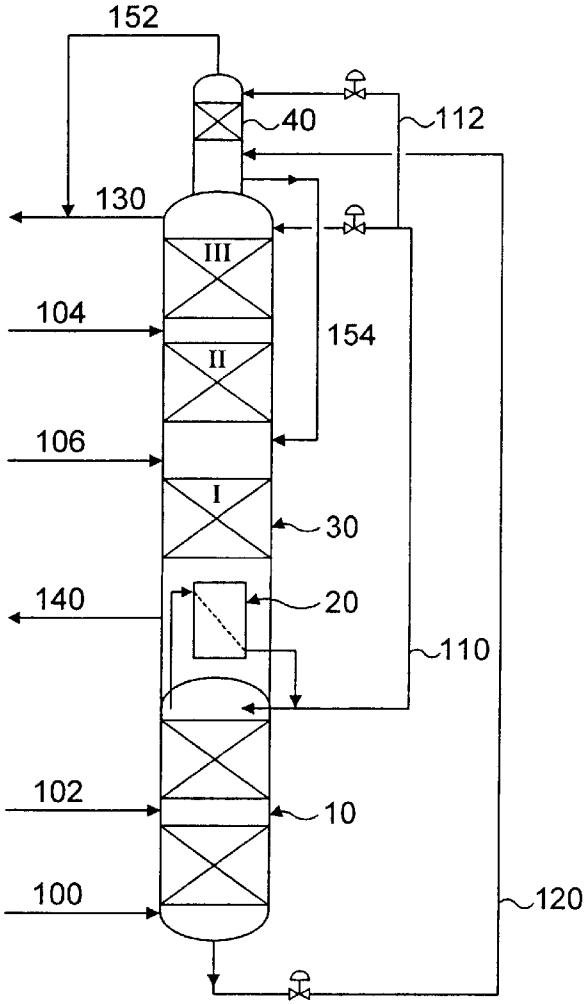
FIG. 5 is a diagrammatic representation of an embodiment of the present invention in which oxygen-containing gas for the auxiliary column is provided by flash vapor produced from CLOX removed from the bottom of the HP column.

In FIG. 5, the source of the low pressure vapor processed by the auxiliary column 40 is flash vapor formed when CLOX is reduced in pressure to form a stream 120 of CLOX comprising flash vapor. The quantity of CLOX flash vapor formed if the CLOX is not subcooled can be as high as 15 mol % of the CLOX flow. This flash vapor could be separated outside the auxiliary column 40 but it is convenient to route the unseparated CLOX stream 120 into the bottom of column 40 as shown in FIG. 5 and use the sump as a separator. In FIG. 5, auxiliary column 40 could be operated at a different pressure to the LP column 30 and the stream 152 of nitrogen-rich overhead vapor could then be withdrawn as a separate product stream rather than being mixed with stream 130 as shown.

Figure 6:
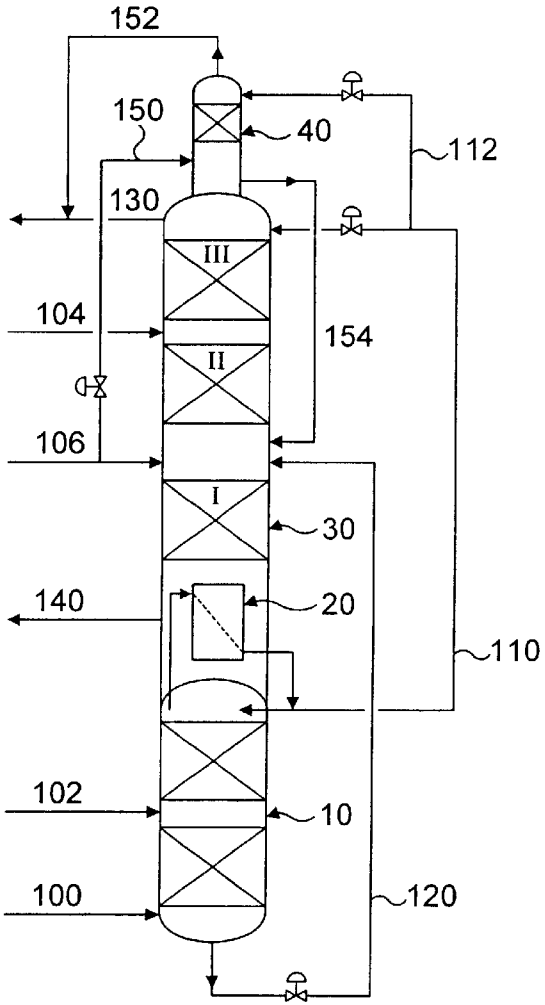
FIG. 6 is a diagrammatic representation of an embodiment of the present invention in which oxygen-containing gas for the auxiliary column is provided by an air expansion turbine.

In FIG. 6, the source of the vapor for the auxiliary column 40 is all or part of the discharge stream 106 from an air expansion turbine. As in FIG. 5, auxiliary column 40 of the system in FIG. 6 could be operated at a different pressure than the LP column 30 and stream 152 recovered as a separate product stream rather than being mixed with stream 130 as shown.

EXAMPLE

An air separation plant similar to that shown in FIG. 1 above was designed to produce pure oxygen product. The CLOX stream 120 was not subcooled. The double column was designed using standard density structured packing in all sections. It was found that the necessary cross-sectional area of LP column section III has to be about 20% greater than that of section I at the same approach to flooding in each section.

If the same air separation plant is designed according to FIG. 5 above then the flashgas in CLOX stream 120 passes up through the auxiliary column. The flow of waste gas 152 leaving the auxiliary column 40 is about 10% of the total waste gas flow and, thus, section III of the LP column 30 only has to pass about 90% of the total waste gas flow. The purities of the waste gases leaving the auxiliary column 40 and the LP column 30 as streams 152 and 130 respectively are approximately the same. Although 10% of the total waste nitrogen gas is produced as stream 152 from the auxiliary column 40, slightly more than 10% (actually 10.6%) of the total reflux is routed to the auxiliary column 40, i.e. the auxiliary column typically runs with a liquid to vapor ratio slightly higher than in section III of the LP column.

The cross-sectional area of section I is unchanged. However, for section III, the cross sectional area is about 10% lower than for the plant designed according to FIG. 1, for the same approach to flood. The auxiliary column cross-sectional area is only about 11% of that for section III and only requires about ten theoretical stages. Minimal energy consumption differences are found for the two designs as, in the FIG. 5 design, power consumption is less than 0.1% greater than that encountered using the FIG. 1 design.

Throughout the specification, the term "means" in the context of means for carrying out a function is intended to refer to at least one device adapted and/or constructed to carry out that function.

It will be appreciated that the invention is not restricted to the details described above with reference to the preferred embodiments but that numerous modifications and variations can be made without departing from the spirit and scope of the invention as defined by the following claims.

What is claimed is:

1. A process for the cryogenic separation of air using a multiple column distillation system comprising at least a higher pressure ("HP") column (10) and a lower pressure ("LP") column (30), said process comprising:

feeding (100) cooled feed air to the HP column (10) for separation into HP nitrogen-enriched overhead vapor and crude liquid oxygen ("CLOX");

feeding (104, 106, 120) at least one LP column feed stream comprising nitrogen and oxygen to the LP column (30) for separation into LP nitrogen-rich overhead vapor and liquid oxygen ("LOX");

refluxing the LP column (30) with a liquid stream (110) front or derived from the HP column (10);

feeding (106, 120, 150) oxygen-containing gas comprising no more than about 50 mol % oxygen to an auxiliary separation column (40) for separation into auxiliary column nitrogen-rich overhead vapor and oxygen-rich liquid;

feeding (154) oxygen-rich liquid from the auxiliary column (40) to an intermediate location in the LP column (30); and refluxing the auxiliary column (40) with a liquid stream (112) from or derived Iron, the HP column (10), characterized in that the vapor flow rate in the auxiliary column (40) is determined such that the diameters of the upper sections (II, III) of the LP column (30) are not larger than that for any other section of the multiple distillation column system.

2. The process of claim 1, wherein the vapor flow rate in the auxiliary separation column (40) is less than about 25% of the vapor flow rate in the upper LP column sections (II, III).

3. The process of claim 1, wherein the oxygen-containing gas (106, 120, 150) comprises from about 50 to about 10 mol % oxygen.

4. The process of claim 1, wherein the oxygen-containing gas comprises gas removed (150) from an intermediate location in the LP column (30).

5. The process of claim 4, wherein the gas is removed (150) from a location below the upper sections (II, III) of the LP column (30) having the highest volumetric flow of vapor in the LP column (30).

6. The process of claim 1, wherein the oxygen-containing gas comprises flash vapor produced from reducing the pressure of at least a portion of the CLOX (120) produced in the HP column (10).

7. The process of claim 6, wherein flash vapor is separated from any CLOX remaining after pressure reduction before being fed to the auxiliary separation column (40).

8. The process according to claim 6, wherein flash vapor is separated from any CLOX remaining after pressure reduction in the auxiliary separation column (40).

9. The process of claim 1, wherein the oxygen-containing gas comprises a proportion of the feed air to the distillation system.

10. The process of claim 9, wherein the oxygen-containing gas comprises at least a portion of the discharge stream (106) from an air expansion turbine.

11. The process of claim 10, wherein part of the turbine discharge stream (106) is fed to the LP column (30).

12. The process of claim 1, wherein the operating pressure of the auxiliary separation column (40) is the same as the operating pressure of the LP column (30).

13. The process of claim 12, wherein gaseous nitrogen ("GAN"), removed (130) from the top of the LP column (30), is combined with auxiliary column nitrogen-rich overhead vapor, removed (152) from the auxiliary column (40), to form a combined nitrogen product stream.

14. The process of claim 1, wherein the operating pressure of the auxiliary separation column (40) is different from the operating pressure of the LP column (30).

15. The process of claim 1 further comprising:

removing HP nitrogen-enriched overhead vapor from the top of the HP column (10);

condensing at least a portion thereof in a reboiler/condenser (20) located in the bottom of the LP column (30); and feeding at least a portion of the condensed nitrogen as reflux to the HP column (10).

16. The process of claim 15, wherein the auxiliary column (40) is refluxed (112) with condensed nitrogen produced in the reboiler/condenser (20).

17. The process of claim 15, wherein the auxiliary column (40) is refluxed with fluid removed from an intermediate location in the HP column (10).

18. The process of claim 1, wherein liquid in the auxiliary separation column is not boiled by a reboiler/condenser.

19. Apparatus for the cryogenic separation of air by the process of claim 1, said apparatus comprising:

an HP column (10) for separating cooled feed air (100) into HP nitrogen-enriched overhead vapor and CLOX:

an IF column (30) for separating at least one LP column feed stream (104, 106, 120) comprising nitrogen and oxygen into LP nitrogen-rich overhead vapor and LOX;

conduit means (110) for feeding a liquid stream train or derived from the HP column (10) as reflux tome LP column (30);

an auxiliary separation column (40) for separating oxygen-containing gas (106, 120, 150) comprising no more than about 50 mol % oxygen into auxiliary column nitrogen-rich overhead vapor and oxygen-rich liquid;

conduit means (154) for feeding oxygen-rich liquid from the auxiliary column (40) to an intermediate location in the LP column (30); and conduit means (112) for feeding a liquid stream from or derived from the HP column (10) as reflux to the auxiliary column (40), characterized in that said auxiliary separation column (40) being capable of accommodating a vapor flow rate such the the diameters of the upper sections (II, III) of the LP column (30) are not larger than that for any other section of the multiple distillation column system.

20. The apparatus of claim 19, wherein the vapor flow rate in the auxiliary column (40) less than about 25% of the vapor flow rate in the upper sections (II, III) of the LP column (30).

21. The apparatus of claim 19 further comprising conduit means (150) for feeding oxygen-containing gas from an intermediate location in the LP column (30) to the auxiliary separation column (40).

22. The apparatus of claim 21 wherein the intermediate location is below the upper sections (II, III) of the LP column (30) having the highest volumetric flow of vapor in the LP column (30).

23. The apparatus of claim 19 further comprising pressure reduction means for producing flash vapor from CLOX removed from the HP column (10) and conduit means (120) for feeding said flash vapor to the auxiliary separation column (40).

24. The apparatus of claim 19 further comprising conduit means (106) for feeding to the auxiliary column a proportion of the feed air to the distillation system.

25. The apparatus of claim 24 further comprising an air expansion turbine and conduit means (106) for feeding at least a portion of a discharge stream from said turbine to the auxiliary separation column (40).

26. The apparatus of claim 19, further comprising:

a reboiler/condenser (20) for condensing at least a portion of said HP nitrogen-enriched overhead vapor by indirect heat exchange against LOX in the bottom of the LP column (30);

conduit means for feeding HP nitrogen-enriched vapor from the top of the HP column (10) to the reboiler/condenser (20); and conduit means for feeding at least a portion of condensed nitrogen as reflux from the reboiler/condenser (20) to the top of the HP column (10).

27. The apparatus of claim 26 further comprising conduit means (112) for feeding condensed nitrogen from the HP column (10) as reflux to the auxiliary separation column (40).

28. The apparatus of claim 26 further comprising conduit means for feeding fluid removed from an intermediate location in the HP column (10) as reflux to the auxiliary separation column (40).

29. The apparatus of claim 19 wherein the auxiliary separation column (40) does not have a reboiler/condenser.

30. A process for the cryogenic separation of air using a multiple column distillation system comprising at least a higher pressure ("HP") column (10) and a lower pressure ("LP") column (30), said process comprising:

feeding (100) cooled teed air to the HP column (10) for separation into HP nitrogen-enriched overhead vapor and crude liquid oxygen ("CLOX");

feeding (104, 106, 120) at least one LP column feed stream comprising nitrogen and oxygen to the LP column (30) for separation into LP nitrogen-rich overhead vapor and liquid oxygen ("LOX");

refluxing the LP column (30) with a liquid stream (110) from or derived from the HP column (10);

feeding (106, 120, 150) oxygen-containing gas comprising no more than about 50 mol % oxygen to an auxiliary separation column (40) for separation into auxiliary column nitrogen-rich overhead vapor and oxygen-rich liquid;

feeding (154) oxygen-rich liquid from the auxiliary column (40) to an intermediate location in the LP column (30); and refluxing the auxiliary column (40) with a liquid stream (112) from or derived from the HP column (10), characterized in that the vapor flow rate in the auxiliary separation column (40) being less than about 25% of the vapor flow rate in the upper LP column sections (II, III).

31. Apparatus for the cryogenic separation of air by the process of claim 1, said apparatus comprising:

an HP column (10) for separating cooled food air (100) into HP nitrogen-enriched overhead vapor and CLOX;

an LP column (30) for separating at least one LP column feed stream (104, 106, 120) comprising nitrogen and oxygen into LP nitrogen-rich overhead vapor and LOX;

conduit means (110) for feeding a liquid stream Iron, or derived from the HP column (10) as reflux to the LP column (30);

an auxiliary separation column (40) for separating oxygen-containing gas (106, 120, 150) comprising no more than about 50 mol % oxygen into auxiliary column nitrogen-rich overhead vapor and oxygen-rich liquid;

conduit means (154) for feeding oxygen-rich liquid from the auxiliary column (40) to an intermediate location in the LP column (30); and conduit means (112) for feeding a liquid stream from or derived from the HP column (10) as reflux to the auxiliary column (40), the improvement consisting of said auxiliary separation column (40) being capable of accommodating a vapor flow rate of less than about 28% of the vapor flow rate in the upper sections (II, III) of the LP column (30).

* * * * *

UNITED STATES PATENT AND TRADEMARK OFFICE

CERTIFICATE OF CORRECTION

PATENT NO. : 6,651,460 B2
DATED : November 25, 2003
INVENTOR(S) : O'Connor

It is certified that error appears in the above-identified patent and that said Letters Patent is hereby corrected as shown below:

Column 9,
Line 9, delete "front" and substitute therefore -- from --.
Line 19, delete "Iron" and substitute therefore -- from --.

Column 10,
Line 21, delete ""IF" and substitute therefore -- LP --.
Line 24, delete "train" and substitute therefore -- from --.
Line 25, delete "tome" and substitute therefore -- to the --.

Column 12,
Line 17, delete "Iron" and substitute therefore -- from --.

Signed and Sealed this

Third Day of February, 2004

JON W. DUDAS
*Acting Director of the United States Patent and Trademark Office*